United States Patent [19]

Agoston et al.

[11] Patent Number: 4,705,990

[45] Date of Patent: Nov. 10, 1987

[54] TUNABLE MAGNETRON

[75] Inventors: Andras Agoston, Täby; Lennart P. J. Mattsson, Vallentuna, both of Sweden

[73] Assignee: U.S. Philips Corporation, New York, N.Y.

[21] Appl. No.: 799,420

[22] Filed: Nov. 19, 1985

[30] Foreign Application Priority Data

Nov. 23, 1984 [SE] Sweden ..... 8405917

[51] Int. Cl.[4] ..... H01J 25/50

[52] U.S. Cl. ..... 315/39.55; 315/39.71

[58] Field of Search ..... 378/119, 132, 144; 384/492, 907; 315/39.55, 39.57, 39.61, 39.51, 39.71

[56] References Cited

U.S. PATENT DOCUMENTS

| | | | |
|---|---|---|---|
| 3,343,031 | 9/1967 | Backmark | 315/39.55 |
| 3,711,171 | 1/1973 | Orkin et al. | 384/907.1 |
| 3,720,853 | 3/1973 | Atlee et al. | 313/60 X |
| 4,143,300 | 3/1979 | Cutting et al. | 315/39.55 |

FOREIGN PATENT DOCUMENTS

| | | | |
|---|---|---|---|
| 503618 | 4/1939 | Fed. Rep. of Germany | 315/39.55 |
| 2215370 | 10/1973 | Fed. Rep. of Germany | 378/133 |
| 1589041 | 7/1981 | Switzerland | 384/492 |
| 768084 | 2/1957 | United Kingdom | 378/119 |

*Primary Examiner*—David K. Moore
*Assistant Examiner*—Mark R. Powell
*Attorney, Agent, or Firm*—Robert J. Kraus

[57] ABSTRACT

The invention relates to a tunable magnetron having coaxial cathode and anode systems (13 and 11, 12) which define therebetween an annular, evacuated interaction space (18) and a rotatable tuning body (20, 24) supported by two ball bearings (21, 22). The tuning body (20, 24) with its bearings (21, 22) is situated in an evacuated space (25) communicating with the interaction space (18). A magnetic circuit having two pole shoes (16, 17), situated one on each side of the interaction space for producing an axial magnetic field through the interaction space (18), is closed through the rolling bearing (21) situated closest to the interaction space. In order to prevent magnetic interaction forces between the rolling bodies from influencing the rotation in the case of continuous operation, in particular if the bearings have no retainer ring, at least the rolling bodies in the bearing (21) situated closest to the interaction space (18) are made of non-magnetic material, e.g. non-magnetic hard metal or ceramic material.

5 Claims, 3 Drawing Figures

TUNABLE MAGNETRON

BACKGROUND OF THE INVENTION

The invention relates to a tunable magnetron comprising coaxial cathode and anode systems, defining therebetween an annular evacuated interaction space. The magnetron includes a tuning body which is rotatably supported by means of rolling bearings has an active portion influencing the tuning of the magnetron. This portion has a conductivity which varies circumferentially for producing a periodic varation of the tuning upon rotation of the body. The body, together with its bearings, is situated in a space communicating with the interaction space. A magnetic circuit comprising two pole shoes situated on opposite sides of the interaction space produces an axial magnetic field through the interaction space. The magnetic circuit is closed via the rolling bearing which is axially closest to the interaction space.

Such a magnetron is described in SE Pat. No. 191 373 corresponding to U.S. Pat. No. 3,343,031. It may for example be used to produce HF-pulses whose frequency vary from pulse to pulse. However, in many applications of such a magnetron it is desirable to be able to control the frequency for enabling transmission of pulses having accurately predetermined frequencies.

In particular when pulses having accurately predetermined frequencies are to be transmitted while the tuning body rotates, very severe requirements are laid upon the bearing arrangement of the body. Due to unavoidable time delays in the triggering circuits, the tuning frequency of the magnetron at the instant of transmission and hence the frequency of the transmitted pulse must be predicted a small time interval before the transmission instant, which is made on the basis of the instantaneous timing of the magnetron at the predicted instant and the variation speed of the frequency, i.e. the time derivative of the tuning curve. If the prediction is to be effected with high accuray, then it is a requirement that the tuning curve is very smooth, because each deviation from smoothness of the curve will result in a deterioration in conformity between the predicted transmission frequency and the actual transmission frequency. For achieving the desired effect, the bearings must show a very uniform friction and rolling resistance. Furthermore, the wear must be small for achieving a proper operation life and no wearing products should be allowed to be produced that could penetrate into the interaction space and deposit themselves on the active surface of the cathode. These requirements must be fulfilled in spite of very difficult operation conditions, inter alia involving that the bearings operate in vacuum and are furthermore exposed to a relatively strong static magnetic field and varying temperature conditions.

In a known construction of tunable magnetron, conventional ball bearings of steel are used for supporting the rotatable tuning body. As a result of the fact that the bearings operate in vacuum and at a raised temperature, they cannot be lubricated in the usual manner by means of oil. Due to the difficulties of getting effective lubrication, it has proved to be necessary to decrease the surface pressure, i.e. the load per ball, to a minumum and, in order to achieve this, to increase the number of balls to a maximum. In the bearings of the known magnetrons, the ball retainer ring has therefore been omitted and the balls then roll close to and in direct contact with each other in the space between the inner and outer bearing rings.

A drawback for steel balls is that, at least in the bearing lying closest to the interaction space, the balls are magnetized by the locally prevailing static magnetic field so that each ball forms a small dipole. These magnetic dipoles assume different positions relative to the magnetizing field at the same time as they rotate around their own axis and all the time also assume different mutual positions. This gives rise to mutual attraction and repulsion forces of a more or less random character between the balls. A certain observed lack of smoothness of the tuning curve for continuous rotation of the tuning body with a consequent frequency spread relative to the predicted frequency has been attributed to this phenomenon in the known magnetrons. Mutual attraction forces between the balls and between the balls and the rings furthermore cause "stick-slip"-effects, which have a negative influence on the operation life. A further drawback of steel balls is that their hardness decreases with temperature. This inter alia involves that the temperature during the evacuation process must be limited. Thereby the quality of the vacuum is also limited.

SUMMARY OF THE INVENTION

The object of the invention is to produce a bearing arrangement for the tuning body in a tunable magnetron, which alleviates the drawbacks of the known arrangements.

According to the invention this is achieved such that, in a tunable magnetron as set forth in the opening sentence, the rolling bodies in the rolling bearings are made of non-magnetic material, whereby the influence of magnetic interaction between the rolling bodies on the achieved rotation is eliminated. The non-magnetic material may suitably be a sintered material.

By employing the invention the tuning curve will have a smoother shape, and therefore frequency prediction can be made with greater accuracy than in the known magnetrons. The friction depending on magnetic interaction in conventional bearings of steel due to the described "stick-slip"-effects will disappear completely, which results in less wear and a longer operation life.

Suitably all bearing components, comprising rolling elements and inner and outer rings can be made of non-magnetic material. Then the vacuum pumping can be effected at a higher temperature, which makes it possible to achieve a better vacuum.

In a preferred embodiment the non-magnetic material is a non-magnetic hard metal, that is to say a cemented carbide. The basic type of hard metal, from which all other hard metals are derived, contains as a hard constituent tungsten carbide and as a binder cobalt. The use of cobalt as a binder results in these hard metals being strongly magnetic. For particular applications, where very stringent requirements are laid upon corrosion resistance toughness, the cobalt binder can for the most part be replaced by, for example nickel alloys. Such hard metals, which mainly contain nickel alloys or similar materials as a binder, have non-magnetic, or rather paramagnetic, properties and are useful in the present case.

In another embodiment the non-magnetic sintered material is a ceramic material, e.g. silicon nitride or aluminium oxide. Ceramic material has the advantage of a lower weight, which results in lower centrifugal forces and thereby less wear and lower inertia during rotation of the tuning body.

It is observed that it has already been proposed to use ceramic balls instead of steel balls in the turbine bearings of combustion engines for airplanes. In this case the bearings do not operate in a vacuum or in a magnetic field and the purpose of the ceramic ball is only to achieve more effective combustion and a higher efficiency by virtue of the higher operation temperature and higher speed which can be achieved by using ceramic balls, and furthermore to make lubrication more easy. This already proposed technique does not indicate any solution of the special problems which appear in the magnetron case.

It is further observed that it is known in the case of X-ray tubes with rotable anodes to support the anode by means of ball bearings, in which at least the balls are made of ceramics, see e.g. DE-GM No. 7232284, or hard metal, see e.g. DE-OS No. 2215370, corresponding to U.S. Pat. No. 3,720,853, DE-OS No. 2800854, corresponding to British Pat No. 1,589,041. However, in the last case with hard metal in the balls it is nowhere stated that the hard metal should be non-magnetic. The choice of material here only has connection with the operation conditions of the bearings in a vacuum at a high temperature. They are not exposed to strong magnetic fields. Thus in this case the most essential problem which appears in the magnetron case and which has been solved by the present invention does not exist.

BRIEF DESCRIPTION OF THE DRAWING

The invention is illustrated by way of example with reference to the accompanying drawing figures, in which.

DESCRIPTION OF THE PREFERRED EMBODIMENT

Figure 1:
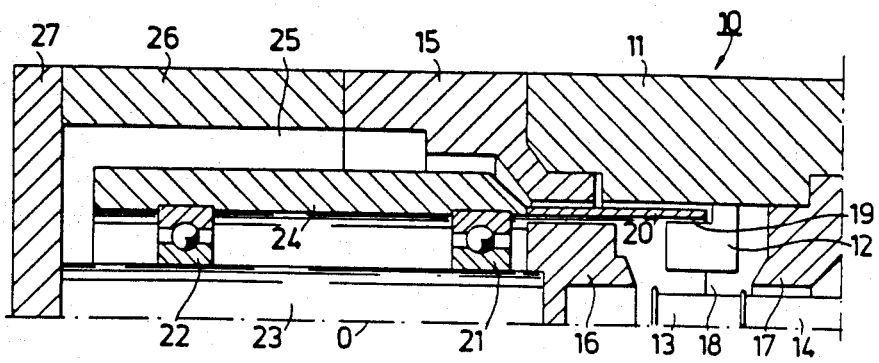
FIG. 1 shows a simplified partial sectional view through a tunable magnetron to which the invention is applicable.

In the drawing figure reference numeral 10 designates an anode system comprising an anode block 11 and radially distributed anode plates 12 which define therebetween sector-shaped tuned cavities. Element 13 is a cathode with supply conductor 14. Element 15 is a pole piece connected to permanent magnetic field means (not shown) and elements 16, 17 are pole shoes producing an axial magnetic field in the interaction space 18 formed between the cathode and the anode plates . A slot 19 is cut at the radially outermost end of such anode plate and extending into this slot is one end of a cylindrical tuning body 20 which is connected to a cylindrical carrier 24 which is rotatably supported on a fixed central shaft 23 by means of two ball bearings 21, 22. The tuning body is made of electrically conductive material and has varying electrical conductivity along its circumference, for example by means of apertures or a toothed shape, in the part projecting into the groove, so that a periodic variation of the tuning of the frequency will be brought about by rotation of the body. The tuning body 20 with its carrier 24 and ball bearings 21 and 22 are situated within an evacuated space 25, which is in communication with the interaction space 18 and which is bounded by a vacuum-tight envelope. Besides the anode block 11 and pole piece 15, this envelope comprises an end cylinder 26 and an end plate 27. The tuning body can be set in a desired angular position or be rotated continuously by means of adjustment means (not shown) which can comprise an electric motor and a magnetic coupling.

Figure 2:
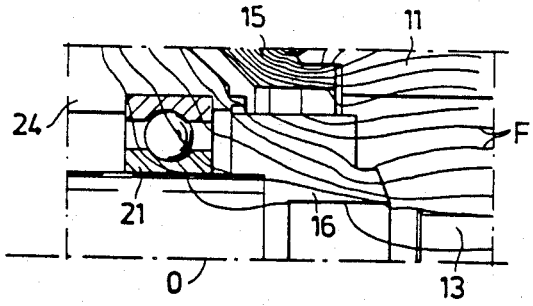
FIGS. 2 and 3 show part of FIG. 1 on an enlarged scale with computer-calculated magnetic field lines, on the one hand for the case where the ball bearings are conventional steel bearings (FIG. 2) and on the other hand for the case where in accordance with the invention the balls are made of non-magnetic material (FIG. 3). The magnetron shown is rotationally symmetrical about the axis O.

FIG. 2 shows part of FIG. 1 on an enlarged scale with computer-calculated magnetic field lines F in the case where the ball bearings are conventional steel bearings. For the sake of clearness the tuning body 20 and the anode plates 12 (FIG. 1), which are made of non-magnetic material, have been omitted from FIG. 2. It is observed that only a fraction of the totally generated magnetic field passes through the interaction space. It is also evident that the ball bearing 21 which is closest to the interaction space will be penetrated by a strong magnetic field, resulting in the steel balls forming small permanent magnets or dipoles. This results in magnetic interaction between the balls themselves and between the balls and the bearing rings, which will give rise to irregular rotation during continuous operation.

Figure 3:
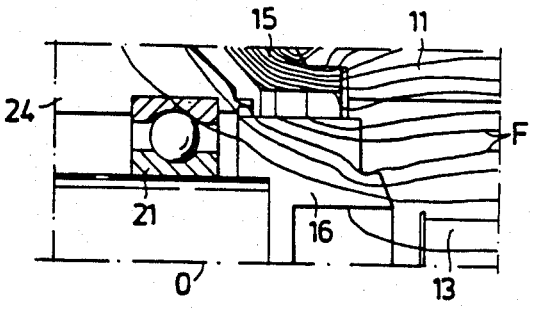

FIG. 3 shows the same picture as FIG. 2 for the case where the balls in the bearing 21 are made, in accordance with the invention, of non-magnetic material. A result of this is that the magnitude of the leakage field through the bearing 21 decreases. Apart from the decrease in the leakage field the use of the non-magnetic balls will result in a number of advantages. All friction due to magnetic attraction will disappear which improves the operation life. In the case of continuous operation, the rotation will be smoother and the accuracy of the predicted frequency will increase. If both the balls and the bearing rings are made of non-magnetic material having high heat resistance, then the temperature during the evacuation pumping operation can be increased, which will improve the vacuum.

In a preferred embodiment, the non-magnetic material of the balls or possibly of the whole ball bearing is a non-magnetic hard metal, i.e. a cemented carbide having non magnetic properties. As hardening constituent the hard metal may contain tungsten carbide, which however to a greater or lesser extent can be replaced by other carbides, such as TiC, TaC, or NbC. As a binder cobalt, generally used in hard metals, can to a large part be replaced by nickel alloys. Hard metals having cobalt as a binder are magnetic, while those having nickel alloys as binders are practically non-magnetic, or rather paramagnetic.

In another embodiment, the non-magnetic material of the balls or of the ball bearing is a ceramic material. The ceramic material can for example be silicon nitride or aluminium oxide.

Another possible non-magnetic material is austenitic stainless steel with a surface coating of titanium carbide, titanium nitride or the like. If the operation temperature of the magnetron can be kept low, other non-magnetic materials could also be used, e.g. "Hadfield"-steel or manganese steel, Haynes-alloy, or beryllium-bronze. Crystalline materials are also possible.

In particular in the case when the ball bearings have no retainer ring so that the balls are free in the space between the outer and inner bearing ring and can come into contact with each other during operation, the use of non-magnetic material in the balls will result in the great advantage that the tuning curve will be smoother in the case of continuous rotation of the tuning body, which in particular results in a better frequency accuracy in relation to the predicted frequency.

Instead of ball bearings other types of rolling bearings can also be used.

What is claimed is:

1. A tunable magnetron comprising:

(a) coaxially-arranged cathode and anode systems defining therebetween an annular evacuated interaction space;

(b) a rotatable tuning body including an annular portion having a circumferentially-varying conductivity disposed proximate the anode system in an evacuated space communicating with the interaction space, said rotatable tuning body during rotation effecting a periodic variation of the frequency to which the magnetron is tuned;

(c) a magnetic circuit comprising first and second pole elements situated on opposite sides of the interaction space for producing a magnetic field directed axially through said interaction space; and (d) means for rotatably supporting the rotatable tuning body and including at least one rolling bearing disposed proximate the magnetic circuit, said rolling bearing comprising rolling bodies consisting essentially of a non-magnetic material, thereby avoiding variations in the magnetic field caused by movement of said rolling bodies.

2. A magnetron as in claim 1 where the at least one rolling bearing, in its entirety, consists essentially of non-magnetic material.

3. A magnetron as in claim 1 or 2 where the non-magnetic material consists essentially of a cemented carbide.

4. A magnetron as in claim 3 where the cemented carbide includes a nickel binder.

5. A magnetron as in claim 1 or 2 where the non-magnetic material consists essentially of a ceramic material.

* * * * *